United States Patent [19]

Seim et al.

[11] Patent Number: 4,658,102

[45] Date of Patent: Apr. 14, 1987

[54] ELECTRIC SWITCH

[75] Inventors: Burkhart Seim, Radevormwald; Karl-Georg Eicker, Remscheid, both of Fed. Rep. of Germany

[73] Assignee: K. A. Schmersal GmbH & Co., Fed. Rep. of Germany

[21] Appl. No.: 909,198

[22] Filed: Sep. 19, 1986

Related U.S. Application Data

[63] Continuation of Ser. No. 770,522, Aug. 29, 1985, abandoned.

[51] Int. Cl.[4] ..... H01H 3/00; H01H 9/28; H01H 13/18

[52] U.S. Cl. ..... 200/17 R; 200/43.07; 200/61.62; 200/153 L

[58] Field of Search ..... 200/17 R, 43.07, 61.62–61.68, 200/153 L, 302.2, 340

[56] References Cited

U.S. PATENT DOCUMENTS 4,395,608 7/1983 Eicker et al. ..... 200/43.07 X 4,524,251 6/1985 Schulz ..... 200/340 X

*Primary Examiner*—J. R. Scott

*Attorney, Agent, or Firm*—Orrin M. Haugen; Thomas J. Nikolai; Frederick W. Niebuhr

[57] ABSTRACT

An electrical switch having a contact carrier plunger which is rectilinearly guided in a housing and which can be driven by rotatable cam rollers which are arranged to be rotated on a shaft by an actuating member inserted through an opening in the switch housing. The arrangement is configured so that the roller rotation will be locked when an actuating member differing from a prescribed predesigned shape is attempted to be used. When an actuating member of the predetermined shape is employed, however, the two rollers can be laterally displaced from one another along their axis of rotation to unlock the plunger movement as the actuating member is forced against mating surfaces performed on the rollers. The openings through which the actuating member may be inserted each consists of two slots separated by an intermediate wall. The actuating member has a slot corresponding to the thickness of the intermediate wall to enable actuation of the switch only if an actuating member of a predetermined shape configuration is inserted in the slots.

18 Claims, 1 Drawing Figure

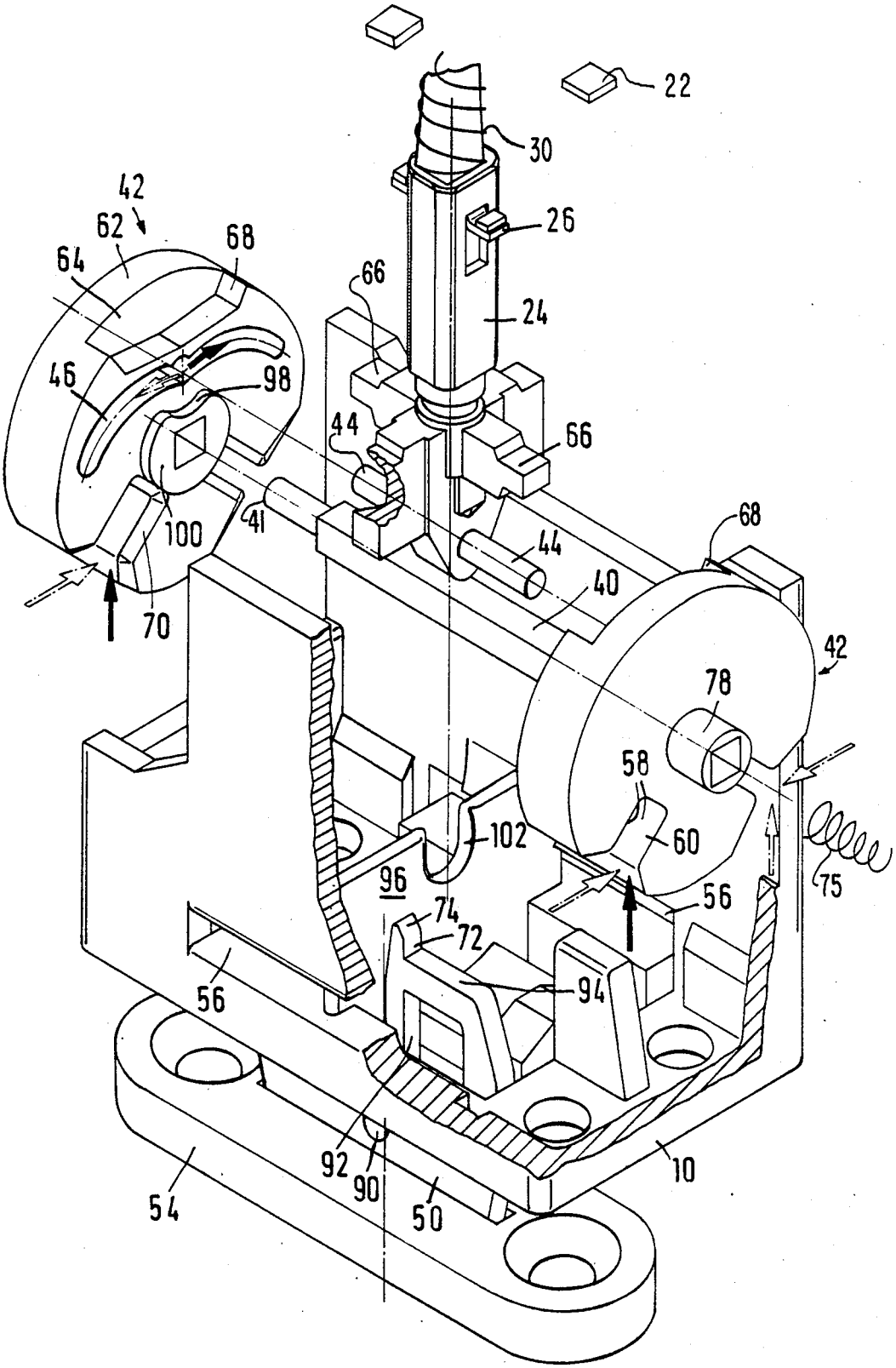
22
30
26
24
42
62
68
64
66
46
98
44
66
100
41
68
44
40
70
42
78
58
102
60
96
75
56
74
72
94
56
92
90
50
54
10

ELECTRIC SWITCH

This is a continuation of application Ser. No. 06/770,522, filed Aug. 29, 1985 now abandoned.

BACKGROUND OF THE INVENTION

I. Field of the Invention

This invention relates generally to an electric switch, and more particularly to an improved design of an electrical safety switch in which the electrical contacts thereof can be closed only upon the insertion of an actuating member of a predetermined shape through one or more apertures formed in the switch housing.

II. Discussion of the Prior Art

So that certain electrical devices, such as building elevators, power tools and related equipment, can only be operated by authorized personnel, it had been found convenient to equip those devices with safety switches which can only be operated to close an electrical circuit upon the introduction of a specially shaped "key" through an opening in the switch housing. Such an electrical switch is described in the Schulz U.S. Pat. No. 4,524,251, which patent is assigned to the same assignee as the present application. That patent describes an electrical switch in which a housing is provided having three chambers, one of which includes a set of normally-open electrical contacts which can be bridged or closed by the actuation of a spring-biased push rod on which the bridging contacts are mounted. This push rod passes through a set of sealing bellows contained within a second chamber of the switch housing and into a third chamber containing a pair of cam rollers which, when appropriately actuated by a generally U-shaped tool, causes reciprocating motion of the push rod to close the normally-open contacts. One or more openings are provided in the switch housing proximate the roller chamber through which the U-shaped actuating member may be introduced. If an actuating member of a shape differing from the predesigned one is pushed in through one of the housing openings, the cam rollers are locked and cannot cause a switch closure. When the appropriate actuating member is used, however, the cam rollers are displaced by that actuating member to the point where they can rotate and thereby move the push rod so as to cause a switch contact closure.

Also related to the present invention is the safety switch assembly disclosed in the Eicker et al U.S. Pat. No. 4,395,608, which is also assigned to the assignee of the instant application.

SUMMARY OF THE INVENTION

In accordance with the teachings of the present invention, there is provided an electrical switch having a housing which may be divided into three chambers, namely, a contact chamber, a sealing chamber and a cam roller chamber. Extending between the contact chamber and the cam roller chamber is a reciprocating contact carrier plunger, the electrical contacts on which are arranged to bridge normally-open contacts contained within the contact chamber when cam rollers in the cam roller chamber are rotated. Rotation of the rollers is achieved through the use of an actuating member which can be pushed into a housing opening. If an actuating member different from a predesigned one is inserted, the rollers are locked against rotation and cannot reposition the contact carrier plunger to close the contacts. The cam rollers themselves comprise two separate roller parts which can be displaced in the direction of their rotational axis against a spring-biasing force urging them toward one another. When the rollers are closely juxtaposed, side-by-side, they are effectively locked against rotation and the actuating member of only a prescribed shape can be used to separate the rollers and thereby unlock them.

A feature of the present invention is that the housing openings through which the actuating member must pass consists of two slots separated by an intermediate wall. The actuating member is designed to have a slot corresponding in width to the thickness of the intermediate wall, and on either side of the slot in the actuating member is a pin-like projection for forcing the two roller parts apart from one another against the biasing force of the spring.

DESCRIPTION OF THE DRAWING

Various features, objects and advantages of the present invention will become apparent to those skilled in the art from the following detailed description of a preferred embodiment especially in conjunction with the accompanying drawing which illustrates by means of a partially-sectioned isometric drawing one embodiment of the electrical switch of the present invention.

DESCRIPTION OF THE PREFERRED EMBODIMENT

Referring to the drawing, there is indicated by numeral 10 a portion of the housing corresponding to the cam roller chamber of the switch arrangement shown in the aforereferenced U.S. Pat. No. 4,524,251. Because the present invention is concerned with an improved design of the cam roller chamber and the actuating member used therewith, it is deemed unnecessary to illustrate in detail the sealing chamber and the switch contact chamber, all of which are illustrated in the aforereferenced patent.

The plunger 24 comprises the contact supporting plunger and identified by numerals 26 are the bridging contacts which would cooperate with the stationary switch contacts 22 integrally contained within the contact chamber the bridging contacts 26 are preferably spring-pretensioned in an upward direction in the slot in the plunger 24 through which they project. Furthermore, a compression spring 30 is disposed between a housing end wall and the end of the plunger 24 facing that end wall to assist the return movement of the plunger 24 so that the movable bridging contacts 26 are normally separated from the stationary contacts 22 within the contact chamber.

The plunger 24 is constrained within the housing for rectilinear motion through the sealing chamber (not shown), and a sealing bellows interacts between the walls of the sealing chamber and the plunger 24 to preclude dust or other contamination from entering the contact chamber and possibly affecting the electrical properties of the contacts themselves.

Directing attention to the roller chamber illustrated in the drawing, two cam roller parts 42 are slidably mounted on a shaft 40. The shaft 40 has a non-circular cross-section over a majority of its length and is dimensioned to slide freely within the central openings 77 in the guide sleeves 78 of the cam rollers.

The cam rollers 42 are preferably made from plastic in an injection molding process or a compression molding process and are identical in construction. The shaft 40 with the cam rollers 42 mounted thereon has cylindrical end portions 41 and this assembly is mounted within the cam roller housing 10 so that it is free to rotate. In order to impart the rectilinear movement of the plunger 24 upon rotation of the cam rollers 42, cam follower pins 44 are affixed to the plunger and are engaged to fit into the cam paths or profiles 46 which are cut into the side surfaces of the cam rollers which face one another. The cam path 46 in each cam roller has the shape of an elongated "3", and, when the rollers are made to rotate in either direction, the plunger 24 will be elevated so that the bridging contacts 26 will ultimately mate with the stationary contacts 22 contained within the contact chamber, provided a separating force is applied between the two cam rollers 42 such that the stop pins 66 on the plunger 24 clear the end edge stops 68 on the cam rollers.

To provide the separating force between the cam rollers 42 and to impart the rotational motion thereto, an actuating member 50 is provided. This actuating member is generally flat and has a centrally-arranged slot 90 formed therein. The member 50 may conveniently be secured to a base 54 and generally rectangular openings 92 are formed through the thickness dimension of the member 50. At the free or exposed end of the actuating member is a surface 94 which is intended to cooperate with the radial slot 60 formed in the cam roller for actuating the switch. The actuating member 50 is dimensioned to pass through any one of four possible slot-like openings 56 formed in the housing 10.

As illustrated in the drawing, one of the slot-like openings 56 is provided in the opposite side walls of the housing 10 while two further openings 56 are arranged parallel to the aforementioned two openings but pass through the bottom or base portion rather than through the side walls. As can readily be observed in this FIGURE, the intermediate wall 96 is positioned to extend transversely through the roller chamber to thereby subdivide all of the slot-like openings 56 in two while at the same time also likewise subdividing the roller chamber. The slot 90 extends from the upper or free end of the actuating member down near to the base 54.

So long as only the surface 94 of the actuating member 50 thrusts against the cam rollers 42, the switch cannot be fully actuated. As alluded to above, the cam rollers 42 also have a notch 64 formed in the inner sided faces thereof in the area 62 adjacent the plunger 24 for receiving stop pins 66 integrally formed on the opposed sides of the plunger member 24. When the rollers 42 rotate, one of the end edge stops 68 of the notch 64 will strike against its associates stop pin 66 on the plunger and prevent further rotation unless the rollers are shifted in the axial direction sufficiently so that the stop pins 66 clear the stops 68.

By providing a chamfered surface 70 at the exterior edge portion of the radial slot 60, a wedge-like surface is created for cooperating with the spike-like extensions 72 which project outwardly adjacent to the slot 90 on the actuating member 50. The inclined flanks 74 of the extensions 72 press the two cam rollers 42 outward against the force of a pair of compression springs 75 which are deployed between the corresponding housing inner wall and the surface of the respective cam roller 42 facing toward the housing inner wall. For ease of viewing, the compression spring shown is illustrated apart from its associated guide sleeve in the drawing but spring 75 would typically surround the guide sleeves 78 on the cam rollers 42.

As an option, the free end of the plunger 24 carrying the cam follower pins 44 can also be designed to have cam follower elements arranged to follow a cam profiles 98 formed on the inwardly directed projection 100 surrounding the central opening 77 of the cam roller 42 rather than the cam path 46. The intermediate wall 96 may also have a recess 102 to accommodate the rotation of shaft 40.

The cam rollers 42 are also provided with guide sleeves 78 on the sides thereof facing toward the inner housing walls. These guide sleeves enclose the section of the shaft 40 having the square cross-section and are used to virtually eliminate tilting and binding of the cam rollers when they are being axially displaced by the insertion of the actuating member 50 through one of the slots 56 as the flanks 74 formed thereon cooperate with the chamfered surfaces 70 on the cam rollers to separate the rollers from one another.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In an electrical switch including a housing containing at least one pair of stationary contacts, a plunger reciprocally mounted in said housing and carrying bridging contacts for engaging said stationary contacts in said housing when the plunger is moved from a normal position to a contact closing position, said housing containing a pair of cam rollers, each including a predetermined cam profile, a cam follower means integral with said plunger and engaged with said predetermined cam profiles to reciprocate said plunger between said normal and contact closing positions responsive to rotation of said cam rollers, wherein each of said cam rollers includes at least one radially inwardly extended slot adapted to receive the free end of an actuator inserted into said housing, thereby to effect rotation of said cam rollers responsive to continued inward movement of said actuator, the improvement comprising:

a shaft supported in said housing and rotatable relative to the housing, said shaft having a non-circular cross-section over a medial portion of its length, and an integrally formed cylindrical extension at each of its ends, said shaft supporting said cam rollers for lateral, reciprocal sliding motion along said medial portion, between a normal roller position and a displaced position in which said rollers are relatively remote from one another;

a biasing means for urging said cam rollers into said normal cam position; a first stop means integral with said plunger; and a second stop means on each of said cam rollers for engaging said first stop means to substantially prevent rotation of said cam rollers when in said normal cam position;

means forming at least one housing opening through a wall of said housing, and a partitioning member for dividing each of said housing openings in two; and an actuating member having a base and a free end opposite the base, said actuating member adapted for insertion by its free end into said housing through any one of said housing openings, said actuating member having an actuating slot open to said free end, extended toward said base, and having a width corresponding to the thickness of said partitioning member to provide clearance between said actuator member and said partitioning member as said actuating member is inserted into said housing; said actuating member including a cam roller moving means at said free end for engaging said cam rollers as said actuating member is inserted, and for moving said rollers laterally away from said normal cam position responsive to further insertion of said actuating member, thereby to disengage said first and second stop means and free said cam wheels to rotate, said actuating member further including cam roller rotating means at said free end for engaging said radially inwardly extended slots to rotate said cam rollers.

2. An electric switch having a housing, said housing having at least one housing opening through a wall of said housing; a plunger mounted for rectilinear motion in said housing; a roller means including two rollers journaled for rotation on an axis within said housing and relative to said housing; at least one bridging contact mounted on said plunger; said rollers and said plunger being operatively connected for effecting rectilinear reciprocal motion of said plunger responsive to rotation of said roller means; each roller of said roller means being displaceable along said axis between a normal position and a displaced position; a biasing means for urging each of said rollers into said normal position; a stop means for engaging each of said rollers when in said normal position to substantially prevent rotation of said roller means and thereby substantially prevent movement of said plunger; and an actuating member insertable by a free end thereof into any one of said housing openings to engage said roller means, said actuating member including a roller displacement means for engaging said roller means and displacing each of said rollers from the normal position against the force of said biasing means as said actuator is further inserted, to disengage said roller means from said stop means and permit said roller means to rotate responsive to yet further insertion of said actuating member; an intermediate wall in said housing and positioned to divide each of said housing openings into two; wherein said actuating member includes an actuating slot open to said free end, extended away from said free end, and having a width corresponding to the thickness of said intermediate wall to provide clearance between said actuating member and said intermediate wall as said actuating member is so inserted.

3. The electric switch of claim 2 wherein:

each of said housing openings is of the same predetermined shape, and said actuating member has a corresponding predetermined shape substantially identical to the shape of each housing opening.

4. The electric switch of claim 2 wherein:

said roller displacement means includes a projection at the free end of said actuator corresponding to each of said rollers, each projection including a wedge-shaped surface for engaging a corresponding chamfered surface portion of each of said rollers.

5. The electric switch of claim 2 wherein:

each of said rollers has an edge stop formed therein for engaging said stop means whenever said roller is in said normal position.

6. The electric switch of claim 2 wherein:

said roller means includes a shaft rotatably mounted in said housing, each of said rollers being slidably supported on said shaft and mounted to rotate with said shaft.

7. The electric switch of claim 6 wherein:

a medial portion of the length of said shaft has a non-circular cross-section, a central opening in each of said rollers has a corresponding non-circular cross-section, and each of said rollers is supported along said medial portion.

8. An electric switch having a housing, said housing having at least one housing opening through a wall of said housing; a plunger mounted for rectilinear motion in said housing; a roller means including two rollers journaled for rotation on an axis within said housing and relative to said housing; at least one bridging contact operatively connected with said plunger; said rollers and said plunger being operatively connected for effecting rectilinear reciprocal motion of said plunger responsive to rotation of said roller means; each roller of said roller means being displaceable along said axis between a normal position and a displaced position; a biasing means for urging each of said rollers into said normal position; a stop means for engaging each of said rollers when in said normal position to substantially prevent rotation of said roller means and thereby substantially prevent movement of said plunger; and an actuating member insertable by a free end thereof into any one of said housing openings to engage said roller means, said actuating member including a roller displacement means for engaging said roller means and displacing each of said rollers from the normal position against the force of said biasing means as said actuator is further inserted, to disengage said roller means from said stop means and permit said roller means to rotate responsive to yet further insertion of said actuating member; at least one intermediate wall in said housing and positioned to divide the at least one housing opening into two; wherein said actuating member includes a slot open to said free end, extended away from said free end, and having a width corresponding to the thickness of said intermediate wall, said slot allowing the insertion of said actuating member by receiving said intermediate wall.

9. The electric switch of claim 8 wherein:

each of said housing openings is of the same predetermined shape, and said actuating member has a corresponding predetermined shape substantially identical to the shape of each housing opening.

10. The electric switch of claim 9 wherein:

one intermediate wall divides at least two of said housing openings into two.

11. The electric switch of claim 10 wherein:

one intermediate wall divides two parallel housing openings through two opposite walls of said housing and at least one housing opening through a wall of said housing connecting said two opposite walls.

12. The electric switch of claim 8 wherein:

said roller displacement means includes two projections at the free end of said actuating means, one on each side of said slot, each for engaging and displacing one of said rollers.

13. The electric switch of claim 12 wherein:

each of said projections includes a wedge-shaped surface for engaging one of said rollers.

14. The electric switch of claim 12 wherein:

each of said rollers is provided with a chamfered surface portion for engaging one of said projections of said actuating means.

15. The electric switch of claim 13 wherein:

each of said rollers is provided with a chamfered surface portion for engaging one of said projections of said actuating means.

16. The electric switch of claim 8 wherein:

each of said rollers has an edge stop formed therein for engaging said stop means whenever said roller is in said normal position.

17. The electric switch of claim 8 wherein:

said roller means includes a shaft rotatably mounted in said housing, each of said rollers being slidably supported on said shaft and mounted to rotate with said shaft.

18. The electric switch of claim 12 wherein:

a medial portion of the length of said shaft has a non-circular cross-section, a central opening in each of said rollers has a corresponding non-circular cross-section, and each of said rollers is supported along said medial portion.

* * * * *